United States Patent [19]

Corso

[11] Patent Number: 4,647,920

[45] Date of Patent: Mar. 3, 1987

[54] FAULT DETECTOR

[76] Inventor: Philip P. Corso, 6607 S. Grande Dr., Boca Raton, Fla. 33433

[21] Appl. No.: 530,888

[22] Filed: Sep. 9, 1983

[51] Int. Cl.[4] ..... G08B 21/00

[52] U.S. Cl. ..... 340/650; 324/51; 340/644

[58] Field of Search ..... 340/650, 649, 651, 652, 340/644, 638, 521; 324/51, 73

[56] References Cited

U.S. PATENT DOCUMENTS 4,398,144 8/1983 Heidemann ..... 340/644 X

*Primary Examiner*—Charles A. Ruehl

*Assistant Examiner*—Daniel Myer

*Attorney, Agent, or Firm*—Malin, Haley & McHale

[57] ABSTRACT

A detector/annunciator circuit for monitoring the status (opened or closed) of field process switches. A two lead "End of Line Device" (ELD) is field mounted proximate the switch, and, during normal operation, detects switch status and transmits this information to panel mounted logic that decodes and annunciates the information. If the ELD's lead wires become open or short circuited, or are subjected to a ground fault, the panel mounted logic can identify the fault, diagnose its type, and annunciate such, thus aiding system troubleshooters.

8 Claims, 1 Drawing Figure

FAULT DETECTOR

BACKGROUND OF THE INVENTION

The invention pertains to electronic circuits for monitoring the operation of field mounted sensors, and, in particular, circuits that annunciate the state of the sensor (i.e. on/off). Such circuits typically have circuit elements located in the field adjacent to the sensor, and have lead wires extending to a central control panel. Often, these wires are subject to electrical faults, i.e. a short circuit (usually caused by loose or sloppily installed wires), an open circuit (usually caused by a break in the lead wires), or a ground fault (usually caused by water accumulated in the field circuit box). Such faults, considered mere nuisances, are not in themselves serious threats to the process system, but do often indicate problems that can become serious (e.g. if the sensor is a thermocouple on a motor, water that shorts the detector leads could also short the motor's power supply), and in any event, render the monitor inoperative, hence depriving system operators of knowledge of the sensor's state. Thus, nuisance or not, these faults must be expeditiously corrected, usually requiring the shutting down of the system and troubleshooting the detector, an expensive and time consuming procedure.

Prior art fault detectors, for example as shown in U.S. Pat. No. 4,185,277 to the instant inventor Corso, use variations on the theme of "unanimous voting," wherein either redundant sensors, or redundant switches responsive to one such sensor, must each indicate the presence of a fault for the detector logic to announce a fault. Such an arrangement gives a system operator no indication of the kind of fault. Additionally, such a detector is highly susceptable to generating spurious fault signals due to random electromagnetic signals impinging on the sensor(s), and cannot prevent "winking" of the detector caused by power dips or by the bouncing of switch contacts, or by supply power dips.

SUMMARY OF THE INVENTION

Accordingly, it is an object of the invention to provide a field switch monitor that, in addition to detecting and announcing the state (open or close) of the switch, can identify and distinguish among the three abovementioned faults, and display this information.

It is a further object of the invention to provide a field switch monitor that is not readily susceptable to generation of false signals in response to stray electromagnetic radiations or power dips.

It is a further object of the invention to provide a simple and inexpensive monitor system that can adapt to a wide variety of extant process systems without requiring complicated interference, and is thus readily retrofit to such extant systems.

Accordingly there is provided a system having an "end of line device" (ELD), located in the field at the sensor switch, for testing the status of the switch, and a detector module containing the logic to interpret and display the information from the ELD. In particular, the ELD contains a pair of zener diodes that cooperate to provide the module with a plurality of signals (voltage windows) corresponding to the switch's position. The detector module has additional logic that can identify and annunciate short circuits or ground faults occurring on the wire connecting the modules and ELD based solely on the voltage of these wires.

In accordance with these and other objects which will be apparent hereinafter, the instant invention will now be described with particular reference to the accompanying drawing.

BRIEF DESCRIPTION OF THE DRAWING

The FIGURE shows the circuit diagram of an embodiment of the instant invention.

DETAILED DESCRIPTION OF THE INVENTION

Figure 1:
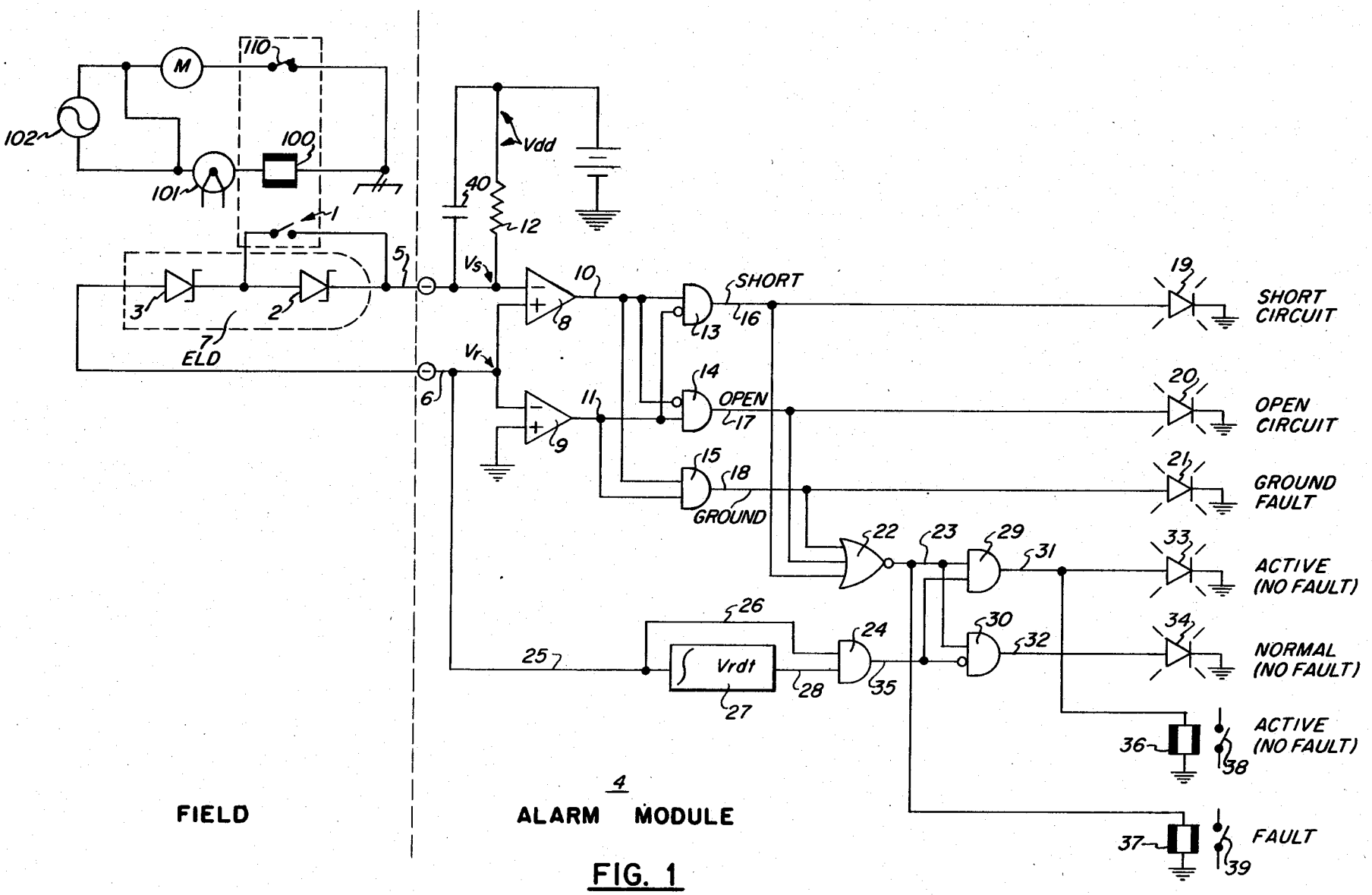

With reference to the FIGURE, an end of line device (ELD) 7 is shown in the field (i.e. distant from control panels, etc.) and proximate field switch 1. Switch 1 is illustrated as a relay having contacts thrown by coil 100. Upon motor thermocouple 101 conducting, power source 102 energizes coil 100, which throws relay contacts 1, 110, the latter disengaging motor M. More broadly, switch 1 can be any process switch that is electrically isolated from its field process. The end of line device consists of two series zener diodes 2, 3, diode 2 being also in parallel with field switch 1. Power for this configuration comes from alarm module 4 via wires 5, 6, which are at potentials that shall be called Vs (source) and Vr (reference). Module power supply Vdd can be any appropriate source, for example a regulated D.C. power supply. For CMOS circuitry, Vdd would be in the vicinity of twelve volts. Connected to Vdd is capacitor 40 which, in combination with the D.C. input impedance of the circuit, has a sufficiently large delay time so that the circuit does not lose supply power during power dips, or falsely annunciate such dips as circuit faults.

The function of end of line device 7 is to vary Vr discretely depending on the state of switch 1. If switch 1 is open (for illustrative purposes, switch 1 shall be considered as it is illustrated in the drawing FIGURE, i.e. normally open), both zener diodes 2 and 3 conduct, and $Vr=Vs-(Vz2+Vz3)$ (i.e. Vs less the sum of each zener diode's breakdown potential). If switch 1 closes, $Vr=Vs-Vz3$. Thus, assuming no circuit faults, Vr can assume two discrete values Vz2 volts apart and corresponding to the two possible states of switch 1. The values of Vz2 and Vz3, as well as module supply voltage Vdd, are selected so that module circuitry interprets Vs−(Vz2+Vz3) as a logical 0, and Vs−Vz3 as a logical 1. For example, for CMOS, a logical 1 would be greater than Vdd/2, and a logical 0 less than Vdd/2.

Turning for the moment from no-fault switch operation, the circuit that diagnoses switch faults shall be described. Such faults consist of short circuits (defined as Vs=Vr), open circuits (defined as VR=0), and ground faults (defined as VS=Vr=0), and are detected by operational amplifiers 8, 9. Although in theory an operational amplifier should produce no output were its inverting and non-inverting inputs identical, in reality any such amplifier has a small offset voltage, typically on the order of a few millivolts. Thus, if the inputs of such a "real world" device were made identical, this offset and the amplifier's gain would drive the amplifier into saturation. This effect is exploited by amplifiers 8, 9 to detect and annunciate the three fault conditions. Upon a short circuit, both of amplifier 8 inputs become Vs, and the offset potential causes the amplifier 8 to saturate, thus generating a logical one at 10. Conversely, amplifier 9 inverting input is at Vs, and its non-inverting input at ground, causing amplifier 9 to be cut-off, thus generating a logical zero at 11.

Upon an open circuit, the non-inverting input of amplifier 8, and the inverting input of amplifier 8, each goes to zero. Amplifier 8 is thus back biased and non-conductive; amplifier 9 has identical inputs, and hence becomes conductive due to its offset potential. Therefore, the logical outputs of amplifiers 8, 9 for an open circuit are the opposite of that for a short circuit, supra.

Upon a ground fault, each input of amplifiers 8, 9 goes to ground (i.e. the drop across resistor 12 is Vdd), and the offset potential of each amplifier causes each to conduct, thus generating a logical 1 at both 10 and 11.

It is thus seen that amplifier 8 conducts for both a short circuit and ground fault, and amplifier 9 both for an open circuit and ground fault. By appropriately feeding the output from amplifiers 8, 9 to and gates 13, 14, 15 (please see the drawing FIGURE), there is generated at 16, 17, 18 signals that correspond to logical 1 when there exists a short circuit (16), open circuit (17), and ground fault (18). These signals are displayed on the module panel by light emitting diodes (LED's) 19, 20, 21. Additionally, outputs from 16, 17, 18 are fed to three input "nor" gate 22, whose output 23 is high (logical 1) only if there is no fault reported at 16, 17, or 18.

As discussed above, the potential Vr corresponds to the position of switch 1, $Vr=Vs-Vz3$ corresponding to a logical 1 (switch 1 active, here closed), and $Vr=Vs-(Vz3+Vz2)$ corresponding to a logical 0 (switch 1 normal). This information is fed to each input of "and" gate 24, directly through line 26 and indirectly through time delay 27, the purpose of the latter being to eliminate spurious switching signals resulting from switch bouncing or stray electromagnetic signals. Upon switch 1 closing and bouncing or merely chattering, the resulting jagged signal along line 25 is integrated by 27, and the integrated signal fed to "and" gate 24 by line 28. Thus, the potential on line 28, and hence the output 35 of gate 24, will rise to a logical 1 only after the time required to integrate the signal to the value of logical 1, by which time any spurious signal will have disppeared.

The output signals at 23 (no fault) and 28 (switch active) are fed to "and" gates 29, 30, as shown in FIG. 1, whose outputs 31, 32 correspond to "no fault, switch active," and "no fault, switch normal" respectively, and are annunciated by LED's 33, 34 respectively.

The foregoing circuit states are summarized in the following table:

| | | Vs | V8+ = V9− | Va+ | V10 | V11 | V16 | V17 | V18 | V31 | V32 |
|---|---|---|---|---|---|---|---|---|---|---|---|
| Short Circuit | S | Vs | Vs | G | H | L | H | L | L | L | L |
| Open Circuit | O | Vs | O | G | L | H | L | H | L | L | L |
| Ground Fault | G | Ground | Ground | G | H | H | L | L | H | L | L |
| Switch Normal | N | Vs | Vs − (Vz3 + Vz2) | G | L | L | L | L | L | L | H |
| Switch Active | A | Vs | Vs − Vz3 | G | L | L | L | L | L | H | L |

in which V8− is the potential at the inverting input to amplifier 8, V9+ the potential at the non-inverting input to amplifier 9, etc.; V10, V11, etc. is the potential at points 10, 11, etc. of the circuit shown in FIG. 1; G indicates "ground," H indicates "high"; and L indicates "low". In terms of circuit logic, this table becomes that of the following truth table:

| | Vr | Vs | V16 | V17 | V18 | V31 | V32 |
|---|---|---|---|---|---|---|---|
| S | 1 | 1 | 0 | 0 | 0 | 0 | 0 |
| O | 0 | 1 | 0 | 1 | 0 | 0 | 0 |
| G | 0 | 0 | 0 | 0 | 0 | 0 | 0 |
| A | 0+ | 1 | 0 | 0 | 0 | 1 | 0 |
| N | 1− | 1 | 0 | 0 | 0 | 0 | 1 |

in which "0+" indicates a logical 0, but greater than ground (i.e. Vs−Vz3+Vz2); and "1−" indicates a logical 1, but less than supply voltage (i.e. Vs−Vz3) (the drop across resistor 12 being negligably small).

Fault signal 23 and active no-fault signal 32, besides being annunciated by the abovedescribed LED's, energize relay coils 36, 37, which close relay contacts 38, 39. These relays provide for an interface with other process equipment that might have different operating voltage (e.g. 120 VAC).

Indeed, from the foregoing it can be seen that the entire system is particularly well-suited to simple retrofits of existing equipment without necessitating complicated interfacing. Switch 1 is electrically isolated from the process apparatus that is to be monitored, and relays 36, 38 and 37, 39 can be similarly used to activate annunciator circuits on extant control panels, hence not limiting the invention to use with control panels having operating voltages compatible with the invention's circuitry.

The instant invention has been shown and described herein in what is considered to be the most practical and preferred embodiment. It is recognized, however, that departures may be made therefrom within the scope of the invention and that obvious modification may occur to a person skilled in the art.

What we claim is:

1. A diagnostic display circuit comprising a switch means, a diagnostic means, a source voltage within the diagnostic means, circuit ground, and a plurality of wires between the switch means and diagnostic means, the plurality of wires comprising a lead wire and a return wire, the source voltage, lead wire, return wire, and switch means being connected in electrical series, the switch means being located between the lead and return wire, the diagnostic means comprises means for detecting faults, the faults selected from the group consisting of: a short circuit between the lead and return wires, a grounding of the lead wire, and an open circuit in either the lead or return wire, the means for detecting faults comprises a first and a second operational amplifier, each operational amplifier having a non-inverting input, an inverting input, and an offset voltage between the inverting and non-inverting inputs, and wherein the inverting input of the first operational amplifier is electrically connected to the lead wire, the non-inverting input of the second operational amplifier is electrically connected to the return wire.

2. The circuit of claim 1, wherein the diagnostic means comprises means for detecting faults, the faults selected from the group consisting of: a short circuit between the lead and return wires, a grounding of the lead wire, and an open circuit in either the lead or return wire.

3. A diagnostic display circuit comprising a switch means, a diagnostic means, a source voltage within the diagnostic means, circuit ground, and a plurality of wires between the switch means and diagnostic means, the plurality of wires comprising a lead wire and a return wire, the source voltage, lead wire, return wire, and switch means being connected in electrical series, the switch means being located between the lead and return wire, and a detector means responsive to the switch means for providing at the return wire potentials uniquely corresponding to the state of the switch, the detector means comprises a first zener diode reversed biased by the voltage source in electrical parallel with the switch means, and a second zener diode reversed biased by the voltage source in series with the switch means, the diagnostic means comprises means for detecting faults, the faults selected from the group consisting of: a short circuit between the lead and return wires, a grounding of the lead wire, and an open circuit in either the lead or return wire, the means for detecting faults comprises a first and a second operational amplifier, each operational amplifier having a non-inverting input, an inverting input, and an offset voltage between the inverting and non-inverting inputs, and wherein the inverting input of the first operational amplifier is electrically connected to the lead wire, the non-inverting input of the second operational amplifier is electrically connected to the circuit ground, and the non-inverting input of the first operational amplifier and the inverting input of the second operational amplifier are electrically connected to the return wire.

4. The circuit of claim 3, wherein the switch means has switch contacts, the circuit further comprising time delay means responsive to the potential at the return wire for delaying the detection of a change in position of the switch means until the switch contacts stop bouncing.

5. The circuit of claim 3, wherein the diagnostic means comprises means for detecting faults, the faults selected from the group consisting of: a short circuit between the lead and return wires, a grounding of the lead wire, and an open circuit in either the lead or return wire, and wherein the detector comprises means responsive to the means for detecting faults and the potential at the return wire for detecting switch activation if there is no fault.

6. A diagnostic display circuit comprising a switch means, a diagnostic means, a source voltage within the diagnostic means, circuit ground, and a plurality of wires between the switch means and diagnostic means, the plurality of wires comprising a lead wire and a return wire, the source voltage, lead wire, return wire, and switch means being connected in electrical series, the switch means being located between the lead and return wire, and a detector means responsive to the switch means for providing at the return wire potentials uniquely corresponding to the state of the switch, the diagnostic means comprises means for detecting faults, the faults selected from the group consisting of: a short circuit between the lead and return wires, a grounding of the lead wire, and an open circuit in either the lead or return wire, and wherein the detector comprises means responsive to the means for detecting faults and the potential at the return wire for detecting switch activation if there is no fault, the means for detecting faults comprises a first and a second operational amplifier, each operational amplifier having a non-inverting input, an inverting input, and an offet voltage between the inverting and non-inverting inputs, and wherein the inverting input of the first operational amplifier is electrically connected to the lead wire, the non-inverting input of the second operational amplifier is electrically connected to the circuit ground, and the non-inverting input of the first operational amplifier and the inverting input of the second operational amplifier are electrically connected to the return wire.

7. The circuit of claim 6, wherein the switch means has switch contacts, the circuit further comprising time delay means responsive to the potential at the return wire for delaying the detection of a change in position of the switch means until the switch contacts stop bouncing.

8. A diagnostic display circuit comprising a switch means, a diagnostic means, a source voltage within the diagnostic means, circuit ground, and a plurality of wires between the switch means and diagnostic means, the plurality of wires comprising a lead wire and a return wire, the source voltage, lead wire, return wire, and switch means being connected in electrical series, the switch means being located between the lead and return wire, and a detector means responsive to the switch means for providing at the return wire potentials uniquely corresponding to the state of the switch, said detector means comprises a first zener diode reversed biased by the voltage source in electrical parallel with the switch means, and a second zener diode reversed biased by the voltage source in series with the switch means, said diagnostic means comprises means for detecting faults, the faults selected from the group consisting of: a short circuit between the lead and return wires, a grounding of the lead wire, and an open circuit in either the lead or return wire.

* * * * *